United States Patent [19]

Kühn

[11] 4,407,052

[45] Oct. 4, 1983

[54] STUFFING ATTACHMENT FOR A CONTINUOUSLY OPERATING CRINKLING UNIT

[76] Inventor: Klaus G. Kühn, Winterweg 52, 8751 Obernau, Fed. Rep. of Germany

[21] Appl. No.: 163,252

[22] Filed: Jun. 26, 1980

[30] Foreign Application Priority Data

Jun. 30, 1979 [DE] Fed. Rep. of Germany ..... 2926478

[51] Int. Cl.[3] ..... D06C 23/04; D06J 1/02

[52] U.S. Cl. ..... 26/2 R; 28/155; 223/28; 226/151

[58] Field of Search ..... 26/1, 2 R, 69 R; 28/155, 262, 263, 268; 223/28; 226/151

[56] References Cited

U.S. PATENT DOCUMENTS

| | | | |
|---|---|---|---|
| 3,640,442 | 2/1972 | Lyon | 226/158 |
| 3,987,519 | 10/1976 | Potosnak et al. | 26/1 X |
| 4,134,187 | 1/1979 | Damon, Sr. | 26/2 R |

FOREIGN PATENT DOCUMENTS

| | | | |
|---|---|---|---|
| 21450 | 1/1981 | European Pat. Off. | 26/2 R |
| 1093171 | 11/1960 | Fed. Rep. of Germany | 226/162 |
| 2932495 | 2/1981 | Fed. Rep. of Germany | 26/2 R |
| 478782 | 3/1976 | U.S.S.R. | 53/260 |

*Primary Examiner*—Robert Mackey
*Attorney, Agent, or Firm*—Felfe & Lynch

[57] ABSTRACT

A stuffing attachment for a continuously operating crinkling unit for continuous material, has a stuffing ring which can be moved forwards and backwards in a straight line with an aperture through which a strip of the continuous material passes. The stuffing ring is pushed through a clamping device into the starting zone of a compression tube of the crinkling unit and thereafter withdrawn. As the stuffing ring is withdrawn, the clamping device closes, so that it grips the strip, holds it fast, and pulls it through the aperture of the stuffing ring as the latter travels further back.

8 Claims, 2 Drawing Figures

STUFFING ATTACHMENT FOR A CONTINUOUSLY OPERATING CRINKLING UNIT

BACKGROUND OF THE INVENTION

The invention relates to a stuffing attachment for a continuously operating crinkling unit for continuous material, which has a compression tube with an axis which runs in a straight line in its starting zone and into which the continuous material is stuffed.

Crinkling units serve to impart preferably permanent crinkle-creases to continuous material, particularly textile material and, more particularly, velours and velvets, in order to give the continuous material a special appearance and enhance wearability. In a continuously-operating, compression-tube crinkling unit, a continuous strip of material is pressed through a perforated, warm water-immersed compression tube This randomly creases the continuous material inside the compression tube. The high temperature of the water compression tube causes the continuous material to take up the creases which are then fixed by feeding the material immediately thereafter into cold water.

A known stuffing attachment for pressing continuous strip material into the compression tube has a pair of delivery rollers and a short tubular nozzle. The strip passes through the delivery rollers and then through the tubular nozzle. The pair of delivery rollers and the tubular nozzle are pushed backwards and forwards along a straight-line axis of the compression tube to stuff the strip into the compression tube. This known stuffing attachment has the disadvantage that the continuous material may pile up immediately after the delivery rollers and wrap itself around the delivery rollers instead of passing through the nozzle. This, in turn, undesirably necessitates interrupting the operation.

SUMMARY OF THE INVENTION

It is therefore an object of the invention to produce a comparable stuffing attachment which functions as far as possible without such breakdowns.

This object is achieved, according to the invention, by means of a stuffing ring which reciprocates along the straight-line axis of the compression tube between an inner dead point, at which the stuffing ring is located inside the compression tube, and an outer dead point, at which the stuffing ring is located outside the compression tube. The stuffing ring has an aperture in a plane normal to its direction of movement through which the strip passes to the compression tube. A clamping device at the entry to the compression tube opens so wide that the stuffing ring can pass completely through it, but shuts to the strip.

When the stuffing ring is at its outer dead point, the clamping device grips the strip. The diameter in the aperture of the stuffing ring is matched to the width of the strip sufficiently that the strip does not slide through the aperture while the stuffing ring moves from its outer dead point towards its inner dead point. The section of strip between the stuffing ring and the clamping device is therefore crushed. Then, when the stuffing ring and crushed section of strip reaches the clamping device, the latter is opened wide enough to pass the stuffing ring and crushed section of strip through the clamping device and into the compression tube. The stuffing ring then returns and the clamping device again grips the strip as soon as the stuffing ring has passed through to pull the strip through the aperture of the stuffing ring with the further backward travel of the latter. Thereafter, the stuffing attachment commences a new operating cycle.

The stuffing attachment ensures that the strip cannot entangle itself with the stuffing ring, because the clamping device holds the strip under tension during the second part of the return travel of the stuffing ring. The stuffing attachment thus functions extremely reliably and without breakdowns.

A further advantage of the stuffing attachment is that the length of material transported for each working cycle of the stuffing attachment is precisely defined as the tensioned section between the clamping device and the stuffing ring at its outer dead point. By this means, very high uniformity of the crinkling effect is achieved over the entire length of the continuously processed strip.

The diameter of the aperture of the stuffing ring must be matched to the width of the strip. If the diameter is too large in relation to the width of the strip, the strip can slide through the aperture of the stuffing ring during the forward movement of the latter rather than carried with it. Interchangeable stuffing rings with different diameters are therefore preferably provided.

Alternatively, the diameter of the aperture of the stuffing ring can be variable. The aperture then is preferably defined by an elastic gas pressure chamber in which the gas pressure is adjustable to variably distend the elastic section radially inwardly. The diameter of the aperture then depends on the gas pressure.

The stuffing ring must be pushed right into the compression tube. For this, a stuffing ring support tube is preferably provided which moves the stuffing ring in coaxial alignment with the straight-line axis of the compression tube on its end facing the compression tube. The support tube has smooth internal and external surfaces, so that the continuous material, is in no danger of catching on the support tube. The displacement of the stuffing ring is achieved by any suitable device and is preferably adjustable in such a way that the position of the outer dead point is variable to set the length of stroke. This sets the length of continuous material transported during each stroke, and thereby adjusts the formation of the creases: a short stroke produces smaller crinkle-creases; a larger stroke produces coarser and larger crinkle-creases.

The clamping device has at least two movable clamping jaws and, preferably, four. Each of the clamping jaws is pivotable about a bearing point which is fixed relative to the stuffing attachment so that each jaw can be loaded by at least one spring in such a way that they are resiliently pressed together. The sides of the clamping jaws which face away from the compression tube preferably form a concave surface which is matched to the convex side of the stuffing ring which faces the compression tube. With this arrangement, the clamping jaws continuously assume their clamping position unless the stuffing ring or its support tube is located between them. This design is distinguished by particular simplicity and reliability.

Delivery rollers are preferably located in advance of the stuffing ring for feeding the continuous material from the starting stock to the stuffing ring. The stuffing ring is thereby relieved of the task of pulling off the continuous material from the starting stock. Preferably, the delivery rollers are driven intermittently, during the forward travel of the stuffing ring, and in a manner such that they transport the length of material which is stuffed into the compression tube during each working cycle.

Further advantages and features of the invention are evident from the following description of an exemplary embodiment, with refeence to the drawings, in which:

DETAILED DESCRIPTION OF THE INVENTION

Figure 1:
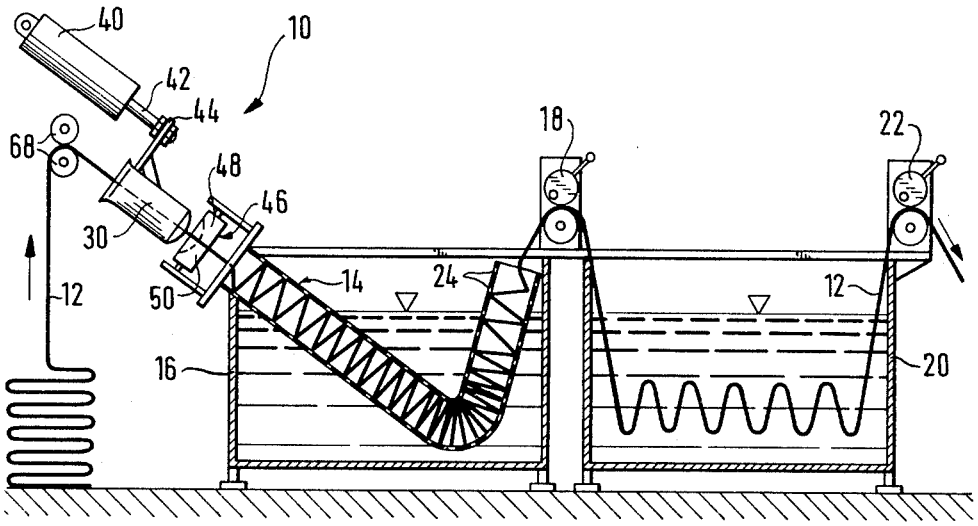
FIG. 1 is a schematic representation of a continuously operating crinkling unit having a stuffing attachment and FIG. 2 is a schematic longitudinal section through an embodiment of a stuffing attachment for the crinkling unit as shown in FIG. 1, individual components being shown in side view.

In the following text, reference is first made to FIG. 1. The crinkling unit represented in this figure includes a stuffing attachment, marked as a whole with the reference number 10, which will be described more comprehensively by reference to FIG. 2. Continuous material, formed into a strip 12, passes through the stuffing attachment 10, and is stuffed by the stuffing attachment into a compression tube 14. The compression tube 14 is perforated and is led through a water bath, contained in a tank 16. During operation, the water bath has a temperature approaching 100° C. The crinkle-creases of the continuous material, which has been crushed in the compression tube 14, are pre-fixed as a result of the high temperature of the water bath. After a certain residence time, the strip 12 emerges both from the compression tube, which is bent upwards at its end, and from the water bath, after which the strip passes through a first pair of squeezing-off rollers 18. Immediately after the pair of squeezing-off rollers, the strip passes through a cold water bath, contained in a second tank 20, whereby the crinkle-creases are finally fixed. After leaving the cold water bath, the strip 12 passes through a second pair of squeezing-off rollers 22. After leaving the second pair of squeezing-off rollers 22, the continuous material has permanent crinkle-creases and is fed on to any further processing that may be desired.

Since the invention concerns the stuffing attachment 10, the remainder of the design of the crinkling unit is not important with regard to the invention. The above short explanation of the remainder of the crinkling unit accordingly indicates merely an example for a possible design of the crinkling unit, and the stuffing attachment 10, according to the invention, can also be employed in combination with crinkling units other than the unit described, as long as the crinkling unit possesses a compression tube with its axis running in a straight line in its starting zone.

Figure 2:
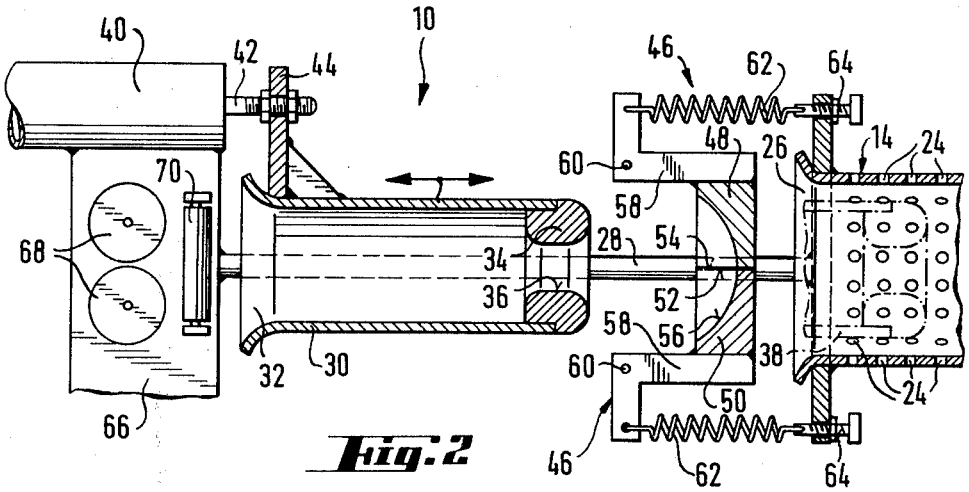
Figure 3:
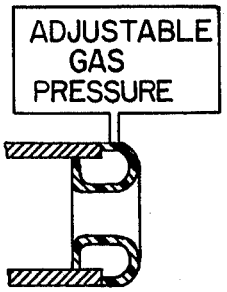
Figure 4:
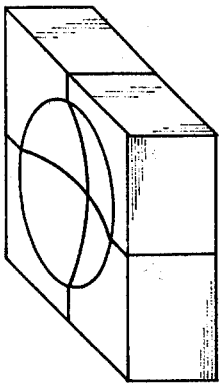
Figure 5:
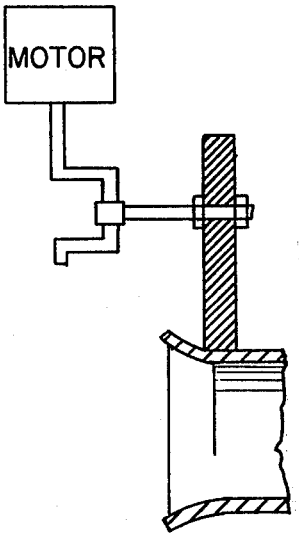

FIG. 2 shows the stuffing attachment 10, schematically and in greater detail, neither the strip 12 nor the frame of the stuffing attachment being shown.

FIG. 2 shows the starting zone of the compression tube 14. In this starting zone, the compression tube, which is provided with numerous holes 24, has a straight-line axis. Two guide rods 28, fixed relative to the stuffing attachment, are located parallel to the straight-line axis of the starting zone of the crushing tube 14, only one of these guide rods being shown in FIG. 2. A cylindrical support tube 30 is displaceably mounted on the guide rods 28, by means of sliding bushes which are not shown. The axis of the cylindrical support tube 30 coincides with the straight-line axis of the compression tube 14. The cylindrical support tube 30 has smooth internal and external surfaces, and possesses a funnel-shaped entry opening 32 at its left-hand end as represented in FIG. 2. On its end facing the compression tube 14, the right-hand end in FIG. 2, the support tube 30 carries a stuffing ring 34. This stuffing ring 34 is designed with a torus-like shape on its outer side, that is to say the side facing the compression tube, and possesses a shoulder around its external periphery, against which the right-hand end of the support tube 30, as shown in FIG. 2, abuts. Externally, the stuffing ring 34 makes a flush transition with the support tube 30 and is attached, in a manner allowing dismantling, to the support tube 30, by means of fasteners which are not shown.

A circular aperture 36 is formed in the stuffing ring 34, which lies in a plane normal to the direction of movement of the support tube 30 and the center of which is located on the straight-line axis of the compression tube 14 and of the support tube 30.

By displacing the support tube 30, the stuffing ring 34 is displaced between an outer dead point, shown in FIG. 2 with continuous lines, and an inner dead point, at which the stuffing ring is located inside the compression tube 14. In FIG. 2, the outline of the stuffing ring and of the forward end of the support tube 30 is represented, for the inner dead point, by a broken line 38. The displacement of the support tube 30 and of the stuffing ring 34 is effected, in the exemplary embodiment shown, by a pneumatic actuator 40, shown in part in FIG. 2, which is located in a fixed position on the stuffing attachment and which possesses a piston rod 42, connected to the support tube 30 via an arm 44. Instead of the pneumatic actuator 40 with its piston rod 42, however, any other suitable drive mechanism can also be provided, which enables the stuffing ring 34 to be moved in a straight line forwards and backwards between its two dead points. For example, a crank mechanism, driven by an electric motor, is also suitable for this purpose.

Both the operating frequency of the actuator 40, that is to say the number of working cycles per unit of time, and the stroke of the actuator 40 are adjustable, the inner dead point of the stuffing ring 34 being, however, unchanged, only the outer dead point being repositioned, that is to say being brought to a greater or smaller distance from the entry opening 26 of the compression tube 14.

A clamping device 46 is located immediately in front of the entry opening 26 of the compression tube 14. In the exemplary embodiment shown, this clamping device 46 comprises two clamping jaws, namely an upper clamping jaw 48 and a lower clamping jaw 50. The clamping device can, however, also possess more than two clamping jaws, for example four clamping jaws. Each clamping jaw has a clamping surface, 52 or 54. The clamping surfaces 52 and 54 face each other and, in the condition represented in FIG. 2, lie in contact with each other, so that the passage opening of the clamping device 46, which is defined by the two clamping surfaces 52 and 54, is completely closed. The sides of the clamping jaws 48 and 50, facing away from the compression tube 14, form a concave surface 56, which is designed in the shape of a cup in the exemplary embodiment shown. This cup-shaped surface 56 is smooth and faces the stuffing ring 34 when the latter is at its outer dead point. Each clamping jaw 48 and 50 is respectively attached to a lever 58, which in each case is pivotable about a bearing point, fixed relative to the stuffing attachment. The bearing points 60 are located on the side of the clamping jaws 48 and 50 facing away from the compression tube 14, so that the clamping jaws can swing away from each other and thereby enlarge the passage opening of the clamping device, if pressure is exerted on the surface 56. The clamping device 46 and its distance from the entry opening 26 are dimensioned such that the passage opening can be opened at least so wide that the support tube 30, together with the stuffing ring 34, can be moved through the passage opening straight into the compression tube 14. In acknowledgment of this requirement, the clamping device 46 is located as close as possible to the compression tube 14.

A spring 62, designed as a tension-spring, engages with each lever 58. An adjustable spring-attachment 64 is mounted at the other end of each spring, by means of which the spring force can be adjusted. The springs 62 press the clamping jaws 48 and 50 resiliently together, so that the clamping device 46 assumes, in the rest condition, the position shown in FIG. 2 and the clamping jaws can be pressed apart against the forces of the springs 62. The clamping force exerted by the clamping surfaces 52 and 54 can be set by means of the adjustable spring-attachments 64.

Delivery rollers 68, rotatably mounted in a frame 66, which is fixed relative to the stuffing attachment, are arranged in the transport direction of the continuous material, in advance of the stuffing ring 34 and the support tube 30, that is to say to the left of the support tube 30 as shown in FIG. 2. The straight-line axis of the compression tube 14 and of the support tube 30 passes through the roll-gap of these delivery rollers. The gap of the delivery rollers 68 is adjustable, and the delivery rollers can be driven, in a controlled manner, by a drive mechanism which is not shown. In the exemplary embodiment shown, the delivery rollers are driven intermittently, during the foward travel of the stuffing ring 34 from its outer dead point to its inner dead point, the delivery rollers 68 always transporting exactly the length of material which is stuffed by the stuffing ring 34 into the compression cylinder 14 during each working cycle.

Two lateral guide rollers are rotatably located on the frame 66, between the delivery rollers 68 and the support tube 30, only one guide roller 70 being shown in FIG. 2. The axes of the guide rollers run at right angles to the axes of the delivery rollers 68.

The mode of operation of the stuffing attachment 10, described above, is explained in the following text. During operation, the strip 12, not shown in FIG. 2, passes through the roll-gap of the delivery rollers 68, through the support tube 30, the aperture 36 of the stuffing ring 34, the passage opening of the clamping device 46, and into the compression tube 14. The gap of the delivery rollers 68 is matched to the thickness of the strip in such a way that the strip 12 is transported reliably. A stuffing ring 34 is inserted into the support tube 30, this stuffing ring having an aperture 36 of a diameter such that the static friction between the stuffing ring 34 and the strip is sufficiently high, on the one hand, so that the stuffing ring 34 carries the strip with it during its forward travel, but without the strip sliding back through the stuffing ring 34 (towards the left in FIG. 2) and, on the other hand, is sufficiently low so that the strip can slide through the stuffing ring 34 during the backward travel of the latter, and can be firmly held by the clamping device 46. The spring force of the springs 62 is adjusted so that the clamping jaws 48 and 50 still hold the strip reliably, while the stuffing ring travels back from the clamping device 46 to its outer dead point.

The operating frequency and stroke of the actuator 40 are adjusted by means of a control device, not shown, an alteration of the stroke of the actuator 40 effecting only an alteration of the position of the outer dead point of the stuffing ring 34, but not of its inner dead point. The length of the section of strip between the clamping device 46 and the stuffing ring 34, when the latter is at its outer dead point, is determined by the position of the outer dead point. This length influences the formation of crinkle-creases in such a manner that a greater length produces coarser creases, while a shorter length produces finer crinkle-creases. The rate of transport of the continuous material, and consequently also the residence time of the material in the water bath in the tank 16, are defined by the operating frequency and the stroke of the actuator 40.

At the start of a working cycle, the components of the stuffing attachment assume the position shown in FIG. 2, note being taken, however, that the strip passes through the stuffing attachment 10 in the manner indicated above. The strip is slightly tensioned between the clamping device 46 and the stuffing ring 34. In the support tube 30, the strip lies slack, between the delivery rollers 68 and the stuffing ring 34. During the forward travel of the support tube 30 and the stuffing ring 34, effected by the actuator 40, the section of strip between the stuffing ring 34 and the clamping device is forced together and compressed. During this process, the pressure exerted by the stuffing ring 34, via the compressed section of strip, on the surface 56 finally becomes so high that the clamping jaws 48 and 50 swing upwards about their bearing points 60, against the spring forces of the spring 62, and the stuffing ring 34 can force the compressed section of strip through the passage opening of the clamping device and through the entry opening 26 of the compression tube 14, straight into the compression tube 14. In doing this, the support tube 30 also passes through the clamping device 46. In the compression tube 14, the strip already present is pushed further by the section of strip which has been additionally transported into the compression tube during this working cycle.

The stuffing ring 34 then starts its return travel from its inner dead point. At the same time, the section of strip which was last stuffed into the compression tube 14 relaxes slightly, while the stuffing ring 34 carries along, initially without sliding, the material which was jammed into its aperture 36. During this first section of the return travel, the clamping jaws 48 and 54 slide over the external surface of the support tube 30 and of the stuffing ring 34, until the surface 56 of the clamping device comes into contact with the outside of the stuffing ring 34 and the clamping jaws 48 and 50 can approach each other to an increasing extent. During this closing movement of the clamping device 46, its clamping jaws 48 and 50 remove any material from the stuffing ring, which may possibly be in contact with the outside of the stuffing ring 34. Finally, the passage opening of the clamping device 46 is closed to such an extent that the clamping surfaces 52 and 54 tightly grip the strip, immediately behind the stuffing ring 34, that is to say to the right of the latter as shown in FIG. 2. From the point in time, at which the clamping device 46 has firmly gripped the strip, the latter slides through the aperture 36 of the stuffing ring 34, the strip being slightly tensioned between the clamping device and the stuffing ring 34. The length of the section of strip, which slides through the stuffing ring 34, until the outer dead point is reached, is the length of continuous material which is transported and stuffed during each working cycle of the stuffing attachment, and is, on the next cycle, again transported, by the delivery rollers 68, during the forward travel of the stuffing ring 34. However, the delivery rollers 68 may also operate continuously, if there is sufficient space between the stuffing ring 34 and the delivery rollers 68 to accommodate the piling up of the continuous material which is being continuously transported.

By reason of the design, as described, and by reason of the mode of operation, as described, piling up of material cannot occur, either behind the delivery rollers 68, or behind the stuffing ring 34, or behind the clamping jaws 48 and 50. The stuffing attachment accordingly functions with extreme freedom from breakdowns. The length of continuous material transported in each working cycle, and accordingly the formation of the crinkle-creases, is precisely controllable.

The invention is not limited to the exemplary embodiment described above.

I claim:

1. A stuffing attachment for a continuously operating crinkling unit having a compression tube with an axis which runs in a straight line in its starting zone and receptive of continuous strip-form material, the attachment comprising: a stuffing ring; means mounting the stuffing ring for displacement in the direction of the straight-line axis of the compression tube between an inner dead point, at which the stuffing ring is located inside the compression tube and an outer dead point, at which the stuffing ring is located outside the compression tube; the side of the stuffing ring facing the compression tube being torus-shaped and said stuffing ring having an aperture in a plane normal to its direction of travel, through which the strip-form material passes; clamping means located upstream of the compression tube and having a variable size passage opening, which can be opened so wide that the stuffing ring can pass completely through to stuff the material into the compression tube, and which can be shut to such an extent that it grips the strip to prevent it from being pulled back by the movement of the stuffing ring, said clamping means comprising at least two movable clamping jaws of which the mutually opposed clamping surfaces limit the passage opening, the sides of the clamping jaws which face away from the compression tube forming a concave surface; and means mounting said clamping jaws for pivotable movement about a bearing point fixed relative to the attachment, said means mounting said clamping jaws including means pressing the clamping jaws in a resilient manner having at least one spring.

2. Stuffing attachment according to claim 1, wherein the stuffing ring includes means for varying the diameter of the aperture of the stuffing ring.

3. Stuffing attachment according to claim 2, wherein the varying means comprises an elastic section defining the aperture and a gas pressure-chamber, surrounding the elastic section in the stuffing ring.

4. Stuffing attachment according to claim 1, wherein the mounting means comprises a support tube displaceably mounted in alignment with the straight-line axis of the compression tube and carrying the stuffing ring coaxially on its end facing the compression tube.

5. Stuffing attachment according to claim 1, wherein the clamping means comprises four movable clamping jaws.

6. Stuffing attachment according to claim 1, further comprising delivery rollers located upstream of the stuffing ring.

7. Stuffing attachment according to claim 1, further comprising a pneumatic actuator connected to the means mounting the stuffing ring for displacing the stuffing ring between its dead points.

8. Stuffing attachment according to claim 1 further comprising a crank mechanism connected to the means mounting the stuffing ring for displacing the stuffing ring between its dead points and an electric motor to drive the crank mechanism.

* * * * *